US006481442B1

(12) United States Patent
Dyakonov et al.

(10) Patent No.: US 6,481,442 B1
(45) Date of Patent: Nov. 19, 2002

(54) SMOKING ARTICLE INCLUDING A FILTER FOR SELECTIVELY REMOVING CARBONYLS

(75) Inventors: Alexander J. Dyakonov, Greensboro, NC (US); David A. Grider, Greensboro, NC (US); Tatyana A. Dyakonov, Greensboro, NC (US)

(73) Assignee: Lorillard Licensing Company, LLC, Greensboro, NC (US)

( * ) Notice: Subject to any disclaimer, the term of this patent is extended or adjusted under 35 U.S.C. 154(b) by 64 days.

(21) Appl. No.: 09/723,842

(22) Filed: Nov. 28, 2000

(51) Int. Cl.[7] ..... A24D 1/04; A24F 7/00

(52) U.S. Cl. ..... 131/334; 131/341; 131/344; 131/345; 131/361

(58) Field of Search ..... 131/331, 332, 131/334, 341, 342, 344, 345, 360, 361, 362

(56) References Cited

U.S. PATENT DOCUMENTS

| | | | | |
|---|---|---|---|---|
| 2,815,760 A | * | 12/1957 | Schreus et al. | 131/207 |
| 2,815,761 A | | 12/1957 | Shearer, Jr. | 131/208 |
| 2,968,306 A | * | 1/1961 | Touey et al. | 131/334 |
| 3,003,504 A | * | 10/1961 | Touey et al. | 131/332 |
| 3,251,365 A | * | 5/1966 | Keith et al. | 131/334 |
| 3,338,249 A | * | 8/1967 | Erlenmeyer | 131/342 |
| 3,339,558 A | | 9/1967 | Waterbury | 131/10.1 |
| 3,340,879 A | * | 9/1967 | Horswell et al. | 131/334 |
| 3,410,282 A | * | 11/1968 | Walker et al. | 131/341 |

(List continued on next page.)

FOREIGN PATENT DOCUMENTS

| | | |
|---|---|---|
| BE | 659839 | 6/1965 |
| DE | 2206 185 | 2/1972 |

OTHER PUBLICATIONS

Carbonyl Group Chemistry, Dr. John Jones, University of Oxford, Last revised 11/99.

Sample Slides by Gita Sathianathan, from the internet, possible prior art.

Article entitled "Advances In Safer Smokes" from the Tobacco Reporter; Dec. 2001.

*Primary Examiner*—Steven P. Griffin
*Assistant Examiner*—Carlos Lopez
(74) *Attorney, Agent, or Firm*—MacCord Mason PLLC

(57) ABSTRACT

A smoking article including a wrapper surrounding a tobacco column and a selective filter element is disclosed. The selective filter element includes at least one carrier having a developed structure and a plurality of moieties capable of the nucleophilic attack of carbonyl-containing combustion products of the smoking article supported by the at least one carrier. The selective filter element may include at least one additional filter element such as cellulose acetate. The developed structure of the at least one carrier encourages the interaction of the carbonyl-containing combustion products and the plurality of moieties capable of the nucleophilic attack. Carries include polymers, which may have branch, such as partially oxidized cellulose and polyaniline. Carries may also be a zeolite or an inorganic oxide such as aluminum, of silicon, of aluminum and silicon, and combinations thereof. In yet another carrier is an activated carbon. A moiety capable of the nucleophillic attack includes a nitrogen and hydrogen containing group such as a hydrazide—(e.g., —NH—$NH_2$), a hydrazone—(e.g., —HC=N—$NH_2$), a semicarbazide—(e.g., —C(=O)—$NH_2$), an imino—(e.g., —HC=NH), and an amino—(—$NH_2$). Preferably, the nitrogen is a primary nitrogen such as a primary amino. A spacer may be used to attach the moiety to a carrier. Examples of spacers include at least one of a —CO— group, —CO—$[CH_2]_n$—CO— group with n=1 through 4 and more.

61 Claims, 1 Drawing Sheet

U.S. PATENT DOCUMENTS 3,429,318 A 2/1969 Walker et al. ..... 131/267
3,667,478 A 6/1972 Waterbury ..... 131/9
3,716,063 A * 2/1973 Litzinger ..... 131/334
3,878,853 A * 4/1975 Lipson et al. ..... 131/334
RE28,858 E 6/1976 Litzinger ..... 131/267
3,972,335 A 8/1976 Tigglebeck et al. ..... 131/267
4,018,678 A 4/1977 Peniston et al. ..... 210/36
4,033,361 A 7/1977 Horsewell et al. ..... 131/262
4,038,992 A * 8/1977 Ogasa et al. ..... 131/207
4,182,743 A 1/1980 Rainer et al. ..... 422/211
4,202,356 A 5/1980 Digenis et al. ..... 131/10.9
4,224,103 A 9/1980 Yamaguchi et al. ..... 162/135
4,300,577 A 11/1981 Horsewell et al. ..... 131/334
4,350,173 A 9/1982 Siren ..... 131/332
4,372,328 A 2/1983 Kausch et al. ..... 131/332
4,392,960 A 7/1983 Kraus et al. ..... 210/651
4,520,134 A 5/1985 Rosen ..... 514/625
4,532,947 A 8/1985 Caseley ..... 131/331
4,662,384 A 5/1987 Green ..... 131/335
4,700,723 A 10/1987 Yoshikawa et al. ..... 131/334
4,753,250 A 6/1988 Bitter et al. ..... 131/334
4,822,816 A 4/1989 Markham ..... 514/474
4,858,629 A * 8/1989 Cundari ..... 131/331
4,910,222 A 3/1990 Puricelli ..... 514/513
4,964,426 A 10/1990 Lee et al. ..... 131/342
4,966,169 A 10/1990 Waddell et al. ..... 131/31
4,967,772 A 11/1990 Waddell et al. ..... 131/334
5,009,239 A 4/1991 Cohen et al. ..... 131/342
5,049,388 A 9/1991 Knight et al. ..... 424/450
5,060,672 A 10/1991 Irimi et al. ..... 131/331
5,083,579 A * 1/1992 Vanin et al. ..... 131/334
5,112,598 A 5/1992 Biesalski ..... 424/46
5,115,824 A * 5/1992 Marshall ..... 131/331
5,249,588 A 10/1993 Brown et al. ..... 131/291
5,331,981 A 7/1994 Tamaoki et al. ..... 131/337
5,364,617 A 11/1994 Bush et al. ..... 424/59
5,380,531 A 1/1995 Chakrabarti et al. ..... 424/450
5,403,834 A 4/1995 Malfroy-Camine et al. . 514/185
5,409,021 A * 4/1995 Safaev et al. ..... 131/331
5,462,963 A 10/1995 Bush et al. ..... 514/248
5,472,002 A 12/1995 Covarrubias ..... 131/335
5,501,238 A 3/1996 Von Borstel et al. ..... 131/331
5,540,242 A 7/1996 Chao et al. ..... 131/365
5,580,575 A 12/1996 Unger et al. ..... 424/450
5,603,927 A 2/1997 Fukumoto et al. ..... 424/76.1
5,667,791 A 9/1997 Hersh et al. ..... 424/401
5,728,462 A 3/1998 Arino et al. ..... 428/393
5,732,718 A 3/1998 Douglas et al. ..... 131/342
5,746,231 A 5/1998 Lesser et al. ..... 131/334
5,758,669 A 6/1998 Taniguchi et al. ..... 131/340
5,780,489 A 7/1998 Brooks ..... 514/369
5,829,449 A 11/1998 Hersh et al. ..... 131/202
5,909,736 A 6/1999 Stavridis et al. ..... 131/331
5,921,248 A * 7/1999 Nicholl et al. ..... 131/331
5,998,500 A 12/1999 Cahill et al. ..... 523/124
6,022,449 A 2/2000 Jansen et al. ..... 162/135
6,119,699 A * 9/2000 Sung ..... 131/200
6,119,701 A * 9/2000 Cerami et al. ..... 131/331
6,209,547 B1 * 4/2001 Koller et al. ..... 131/331
6,289,898 B1 * 9/2001 Fournier et al. ..... 131/360

* cited by examiner

SMOKING ARTICLE INCLUDING A FILTER FOR SELECTIVELY REMOVING CARBONYLS

BACKGROUND OF THE INVENTION

The present invention relates generally to a smoking article including a filter for selectively removing carbonyl-containing combustion products from main stream smoke and, more particularly, a filter for selectively removing carbonyl-containing combustion products, including at least one carrier having a developed structure including a plurality of moieties capable of the nucleophilic attack of carbonyl-containing combustion products.

Some tobacco combustion products contribute to the organoleptic pleasures, while others detract. Among the combustion products that detract are carbonyls including aldehydes, such as acetaldehyde and acrolein, and ketones, such as acetone. When removing detracting combustion products, current filter technology also removes products that contribute to the positive organoleptic pleasure of a smoker. For example, when removing carbonyl-containing combustion products, flavoring additives are removed. Even without flavoring additives, the tobacco combustion products that contribute to the positive organoleptic pleasure of a smoker are removed resulting in an undesirable tobacco product from the consumer's perspective. In both examples, the filtering has proven unacceptable.

Thus, there remains a need for a new and improved smoking article that includes a filter element that selectively removes carbonyl-containing combustion products that detract from the organoleptic pleasures of a smoker, while at the same time, it allows the desirable combustion products to reach the smoker.

SUMMARY OF THE INVENTION

The present invention is directed to a smoking article, including a wrapper surrounding a tobacco column, a selective filter element including at least one carrier having a developed structure, and a plurality of moieties capable of the nucleophilic attack of carbonyl-containing combustion products. The plurality of moieties of the smoking article are supported by the at least one carrier. At least one additional filter element may be provided to filter other combustion products. Preferably, at least one additional filter element is a cellulose acetate. The developed structure of the at least one carrier encourages the interaction of the carbonyl-containing combustion products and the plurality of moieties capable of the nucleophilic attack.

In an embodiment, a carrier is a polymer, preferably having a large surface area such a branched polymer. Preferred polymers include partially oxidized cellulose and polyaniline. In another embodiment, a carrier is an inorganic oxide, preferably a zeolite. Preferred inorganic oxide include an oxide of aluminum, silicon, aluminum and silicon, and their combinations. In yet another embodiment, a carrier is an activated carbon.

A spacer may be used for attaching a moiety to the carrier. Preferred spacers include a —CO— group, a —CO—$[CH_2]_n$—CO— group where n has a value from 1 to 4, a —CO—$[CH_2]_n$—CO— where n has a value greater than 4 and their combinations.

A moieties capable of the nucleophilic attack may include a nitrogen and hydrogen containing group, preferably a primary nitrogen containing group such as an amino—(e.g., —$NH_2$) and an imino—(e.g., —HC═NH), preferably a primary amino group. Preferred moieties capable of the nucleophilic attack include, a hydrazide—(e.g., —NH—$NH_2$), a hydrazone—(e.g., —HC═N—$NH_2$), and a semicarbazide—(e.g., —C(═O)—$NH_2$).

In an embodiment, the selective filter element is a tip added to a smoking article prior to the smoking of the smoking article. The tip may be added by a smoker. Also, a smoking article may further include an additional filter element which is preferably a cellulose acetate filter element.

Accordingly, one aspect of the present invention is to provide a smoking article having a wrapper surrounding a tobacco column and a selective filter element including a plurality of moieties capable of the nucleophilic attack of carbonyl-containing combustion products of the smoking article. Also contemplated is a method for making, a method of operation of and a product resulting from using a smoking article.

Another aspect of the present invention is to provide a selective filter element for use in a smoking article including a wrapper surrounding a tobacco column, the selective filter element having at least one carrier having a developed structure, and a plurality of moieties capable of the nucleophilic attack of carbonyl-containing combustion products of the smoking article supported by the at least one carrier. The developed structure of the at least one carrier encourages the interaction of the carbonyl-containing combustion products and the plurality of moieties capable of the nucleophilic attack. Also contemplated is a method of making, a method of operation of and a product resulting from using a selective filter element.

Still another aspect of the present invention is to provide the smoking article including a wrapper surrounding a tobacco column, a selective filter element including at least one carrier having a developed structure, and a plurality of moieties capable of the nucleophilic attack of carbonyl-containing combustion products of the smoking article supported by the at least one carrier and at least one additional filter element. The developed structure of the at least one carrier encourages the interaction of the carbonyl-containing combustion products and the plurality of moieties capable of the nucleophilic attack. Also contemplated is a method for making, a method of operation of and a product resulting from using a smoking article.

These and other aspects of the present invention will become apparent to those skilled in the art after a reading of the following description of the preferred embodiments, when considered with the drawings.

DESCRIPTION OF THE PREFERRED EMBODIMENTS

Figure 1A:
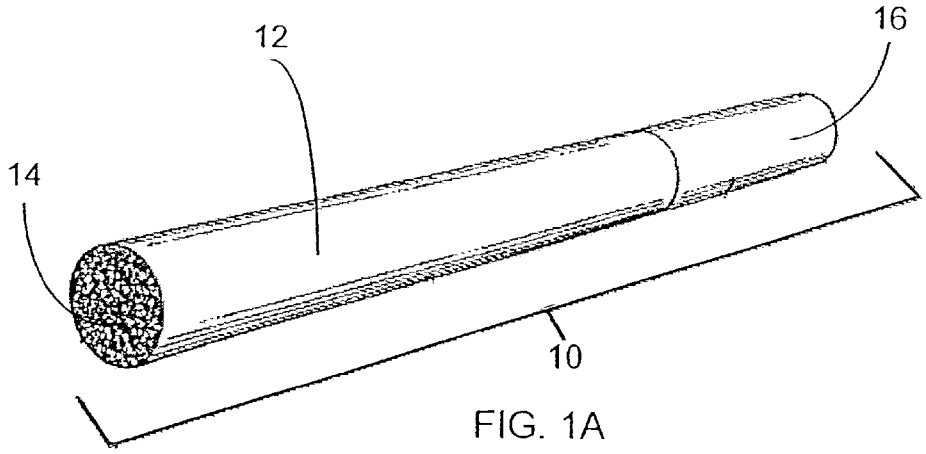
FIG. 1A depicts a smoking article according to an embodiment of the present invention.

In the following description, like reference characters designate like or corresponding parts throughout the several views. Also in the following description, it is to be understood that such terms as "forward," "rearward," "left,"

"right," "upwardly," "downwardly," and the like are words of convenience and are not to be construed as limiting terms.

Figure 1B:
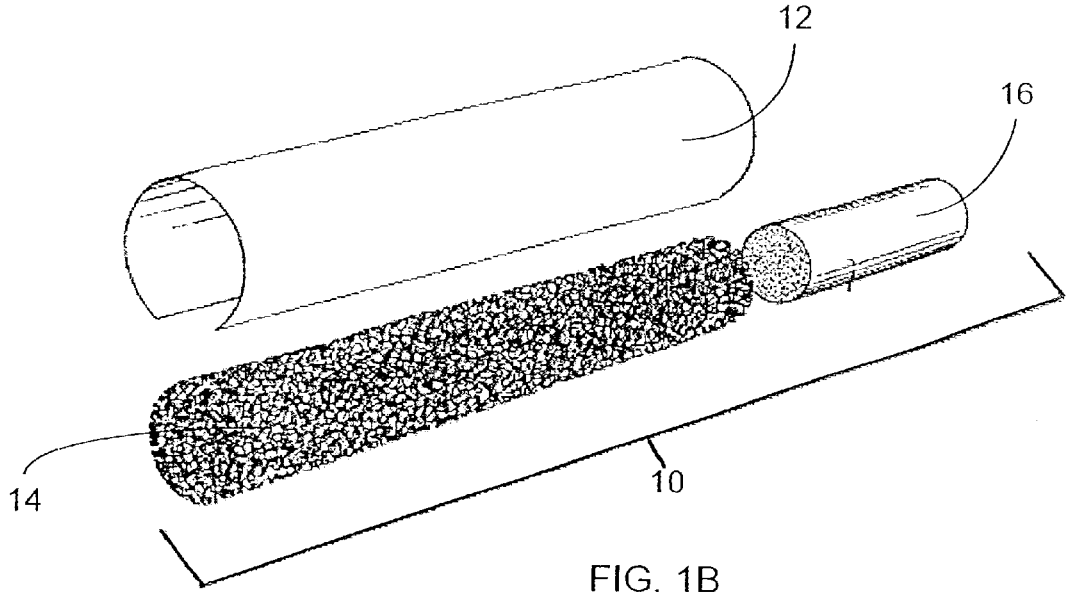
FIG. 1B depicts an exploded view of the smoking article of FIG. 1A.

Referring now to the drawings in general and FIG. 1 in particular, it will be understood that the illustrations are for the purpose of describing a preferred embodiment of the invention and are not intended to limit the invention thereto. As best seen in FIG. 1A, a smoking article 10 includes a wrapper 12 surrounding a tobacco column 14. Adjacent to the wrapped tobacco column 14 is a selective filter element 16. The wrapper 12, tobacco column 14 and selective filter element 16 are shown in the exploded view in FIG. 1B.

Figure 2:
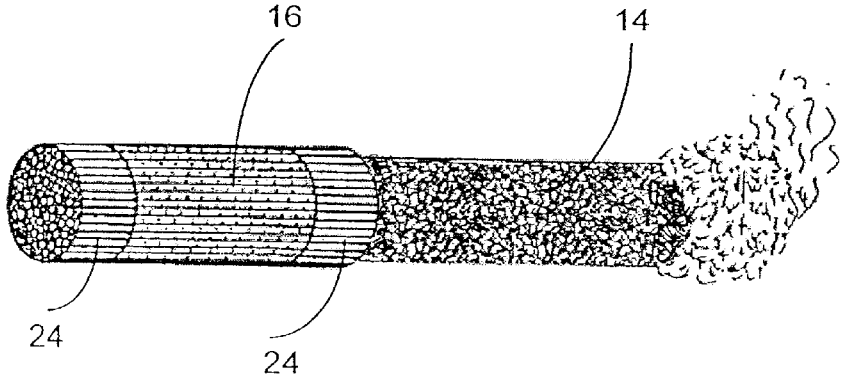
FIG. 2 depicts a selective filter element including an additional filter element according to an embodiment of the present invention.

An alternative arrangement for a selective filter element 16 according the present invention is shown in FIG. 2. In the depicted embodiment, a selective filter element 16 is placed between additional filter elements 24. The invention includes various arrangements for additional filter element 24. For example, a single additional filter element 24 might be used. In one case, additional filter element 24 may reside between selective filter element 16 and tobacco column 14. In another case, selective filter element 16 may reside between additional filter element 24 and tobacco column 14.

Selective filter element 16 includes a carrier 20 including a plurality of moieties 22 capable of the nucleophilic attack of carbonyl-containing combustion products of the smoking article. Applicants have found that acceptable carriers 20 include polymers, inorganic oxides, and activated carbon, also known as activated charcoal.

A carrier 20 that is a polymer may be any one of linear, branched, star-like, comb-type, and combinations and mixtures thereof. Also, a polymer carrier may be any one of a natural polymer, a derivative of a natural polymer, a synthetic polymer, mixtures thereof, copolymers thereof, or a combination of any of the preceding. A natural polymer that has been found to work satisfactorily is a partially oxidized cellulose. Another group of polymers includes those based on aniline and derivatives of aniline.

A carrier 20 that is an inorganic oxide may be any one of a natural zeolite, a derivative of a natural zeolite, a synthetic zeolite, mixtures thereof, and combination of any of the preceding. Also, inorganic oxides may be any one of crystalline, amorphous, mixtures thereof, and combination of any of the preceding. Some examples of inorganic oxides include any one of oxides of aluminum, silicon, mixtures thereof, and combination of any of the preceding.

A carrier 20 is selected to create interaction between the main stream smoke and the carrier so that a mass flow exists through the filter element 16 combined with a high surface area for providing sufficient interaction between the gas phase main stream smoke and the chemical moieties. For example, when an inorganic oxide is used, such oxide is selected for its developed pore structure. An objective of the developed pore structure allows the combustion products of the tobacco column 14 and the wrapper 12 to be drawn through the selective filter element 16 at an acceptable flow rate to maintain the organoleptic pleasure of a smoker.

A selective filter element 16 includes a plurality of moieties 22 that are capable of the nucleophilic attack of carbonyl-containing combustion products of a tobacco column or smoking article. Such moieties 22 may be provided to the carrier 20 by the bonding of the moieties 22 directly to the carrier 20. Alternatively, such moieties 22 may be provided by applying the moieties 22 to the surface of the carrier 20.

Various techniques are known in the art proving the plurality of moieties 22. For example, molecules may be synthesized such that a first end preferentially attaches to a carrier 20, and a second end includes the moieties 22. Dihydrazides reacted with a partially oxidized cellulose carrier are one example. Applicants have found that by providing a stoichiometric excess of dihydrazides in a solution to which partially oxidized cellulose is added, one end of the dihydrazide reacts with the partially oxidized cellulose to attach as a carrier. The strong attachment between the cellulose chain and a hydrazide group creates a structure that has moieties extending from the chain.

Without being bound to any particular theory or explanation, Applicants believe that these extending moieties reach out from the chain into the path of the combustion products as they are drawn through the filter element 16. These combustion products include not only flavorings that provide the desirable organoleptic experience to the smoker, but also carbonyl-containing compounds, such as ketones and aldehydes, that are less desirable. As the carbonyl-containing compounds pass through these extending chains, the moieties attack those carbonyl groups to bond the compounds to a carrier such as a partially oxidized cellulose. Since the partially oxidized cellulose carrier includes a plurality of these moieties, multiple sites are available for attachment of the carbonyl-containing combustion products. With respect to a carrier based on inorganic oxides and activated carbon, molecules including at least one moiety may be on the surface of the carrier 20. Alternatively, molecules including at least one moiety may react with the carrier while having at least one moiety free for reaction with the carbonyl-containing reaction products.

It may be beneficial to include a spacer between the carrier 20 and the plurality of moieties 22. One benefit that may be realized is that a spacer allows the moieties to extend out from the carrier 20 further into a combustion product gas stream. Another benefit that may be realized is that a distribution of moiety displacements from a carrier 20 may be developed to allow a finger-like effect to be created by the gas stream passing through moieties displaced from the carrier 20 through a distribution of distances.

Certain spacers for attaching the plurality of moieties 22 include groups such as carbonyl groups or carbonyl groups with hydrocarbon groups therebetween. This spacer may be exemplified by —CO— or —CO—$(CH)_n$—CO—, where n=1,2,3,4. The number of $CH_2$ groups that may be between the carbonyl compound might be, for example, as little as 1 and as great as 4 or more.

With respect to the plurality of moieties 22, Applicants have found that it is beneficial to have moieties containing nitrogen and hydrogen. Within these types of moieties, it is preferred that the moiety be a primary nitrogen functional group. Examples of such groupings include hydrazide, hydrazone, semicarbazide, imino and amino-groups.

As best seen in FIG. 2 additional filter elements 24 might be used in combination with the selective filter element 16. This additional filter element 24 might include, for example, the types of elements already known in the art such as a cellulose acetate. A benefit of such an additional filter element 24 when placed between the tobacco column 14 and the selective filter element 16 is the removal of compounds that might adversely effect the selective filter element 16. Another benefit of such an additional filter element 24 when placed subsequent to the selective filter element 16 is to ensure a non-detachment of reaction products from the filter element 16 that adversely affect the organoleptic experience of the smoker.

TABLE 1

| Patent | Inventor | Selective Filtering Ability | Selective Filtering Efficiency | Product of Selective Filtering Ability & Selective Filtering Efficiency |
|---|---|---|---|---|
| 5,909,736 | Stavridis, et al. | 4 | 1 | 4 |
| 5,603,927 | Fukumoto, et al. | 3 | 2 | 6 |
| 5,060,672 | Irimi, et al. | 3 | 2 | 6 |
| 5,009,239 | Cohen, et al. | 2 | 2 | 4 |
| 4,372,328 | Kausch, et al. | 2 | 2 | 4 |
| 4,300,577 | Horsewell, et al. | 2 | 2 | 4 |
| 4,202,356 | Digenis, et al. | 2 | 1 | 2 |
| 4,033,361 | Horsewell, et al. | 3 | 1 | 3 |
| 3,429,318 | Walker, et al. | 2 | 1 | 2 |
| RE 28,858 | Litzinger | 3 | 2 | 6 |
| Present Invention | | 5 | 5 | 25 |

1 = ineffective
2 =
3 = semi-effective
4 =
5 = very effective

As summarized in Table 1 above, the selective filtering ability of the present invention is demonstrated by a selective filter's ability to capture carbonyl-type compounds while substantially allowing other compounds to pass (Selective Filtering Ability in Table 1), a selective filter's ability to efficiently capture and continue to capture carbonyl-type compounds (Selective Filtering Efficiency in Table 1), and the product of the Selective Filtering Ability and the Selective Filtering Efficiency.

In operation, the present invention relates to a filter element having a carrier, including a plurality of one or more moieties, capable of nucleophilic attack, that selectively removes carbonyl compounds from main stream tobacco smoke. That is, carbonyl compounds may be represented as RR'CO (where R,R'=H or hydrocarbon radicals) are removed from the main stream smoke. Specific examples of carbonyl compounds removed from main stream tobacco smoke include aldehydes, such as acetaldehyde and acrolein, and ketones, such as acetone. A carrier, such as a cellulose, zeolite, and carbon, supports the plurality of moieties capable of nucleophilic attack. Examples of the moieties include hydrazide-groups, imino-groups and amino-groups.

A mechanism for the trapping of the carbonyl compounds is the chemical bonding of non-detachable moieties to a polymeric chain. A preferred carrier is a partially oxidized cellulosic matrix including a plurality of hydrazide-functional groups incorporated via a spacer. This spacer may be exemplified by —CO— or —CO—$(CH)_n$—CO—, where n=1,2,3,4. Other compounds, including a plurality of one or more moieties capable of nucleophilic attack, include either unsupported dihydrazide or dihydrazide in the form of a low-water-soluble powder of adipic acid dihydrazide.

The following are provided to give a better understanding of the invention and its operation through a discussion of the synthesis, testing and characterization. Hydrazido-cellulose based materials appeared to perform the best amongst the tested materials for filtering the carbonyl-containing compounds. These materials are specified and discussed in Samples 6 through 12. The examples are in no way meant to limit the scope of the claimed invention.

EXAMPLE 1

The present example demonstrates a preparation of a plurality of moieties for a selective filtering element. A polyaniline, imino/amino-representative, was prepared. About 5 grams (g) of aniline (about 99.5% pure obtained from Aldrich Inc.) were dissolved in about 300 milliliters (ml) of an about 1 Molar (M) hydrochloric acid (HCl) solution that was subsequently cooled on ice. About 11 g of ammonium persulphate (about 98% pure) were dissolved in about 200 ml of about 1M HCl solution that was cooled on ice. The ammonium persulphate containing solution was added slowly to the aniline containing solution, while maintaining the temperature below about 10° C. While vigorously stirring, using a magnetic stirrer, the solution resulting from the combination was allowed to equilibrate at about room temperature in about 2 hours (hrs), and then the stirring was continued for about another 20 hrs.

A dark-green precipitate was filtered from the solution resulting from the combination and washed on a filter with about 1 liter (l) of water. This dark-green precipitate was a solid HCl-doped polyaniline that was subsequently suspended in an about 300 ml 1M $NH_4OH$ solution that was mixed for about 20 hrs. A dark-brown polymer, having somewhat the appearance of a copper powder, was filtered from the $NH_4OH$ solution and washed on a filter with about 1 l of water. Solid HCl-doped polyaniline was suspended in 300 ml 1M HCl under mixing for another 20 hrs. The final product (HCl-doped polymer) was thoroughly washed with about 2 l of water, filtered, dried in air at about room temperature for about 24 hrs and stored. The yield of polyaniline was estimated to be more than about 90% (on vacuum-dried weight basis).

The resultant material was milled and sieved to collect approximately about 40 through about 60-mesh fraction of particles. About 250 milligrams (mg) of the milled and sieved material were placed into the filter holder of regular cigarettes between the end of a tobacco column and the acetyl-cellulosic filter.

The cigarettes were smoked mechanically using a Model No. AB, manufactured by Filamatic, Inc., smoking machine (about 2 second (s) puff, followed by an about 58s free smolder). The smoke of the first puff was directed to a gas chromatograph (GC) instrument, Model No. 6890, manufactured by Hewlett Packard. The concentrations of acetaldehyde, acrolein and acetone were measured and normalized to an isoprene internal standard. An unaltered cigarette with cellulose/acetyl-cellulose regular filter was taken as a reference. The polyaniline containing filter of this example removed about 30% of the acetaldehyde, while not significantly changing the concentration of the other compounds.

EXAMPLE 2

The present example demonstrates a preparation of a plurality of moieties for a selective filtering element including a carrier of an activated carbon. A polyaniline on a carrier of an activated carbon (surface area of about 500–1000 meter squared per gram ($m^2/g$) was prepared. About 5 g of activated carbon (obtained from the Calgon Carbon Corporation) were placed in an about 300 ml solution of about 5 g of aniline in an about 1M aqueous HCl solution. The resultant suspension was mixed for about 20 hrs at about room temperature, while the aniline was adsorbed on the carbon. The aniline containing solid particles were then filtered and washed with about 500 ml of water followed by about 100 ml of an about 1M HCl solution. The aniline containing solid particles were then suspended in an about 1M HCl solution, polymerized and further treated substantially according to the step set forth in Sample 1. Testing of cigarettes, including this selective filter element, were done substantially as described in Sample 1. Relative to an untreated activated carbon containing cigarette, the selective filtering was about 10% greater.

EXAMPLE 3

The present example demonstrates a preparation of a plurality of moieties for a selective filtering element including a carrier of an activated carbon. A poly-1,2-diaminobenzene on carrier of an activated carbon was prepared substantially as described in Sample 1 with the exception that about 10 g of 1,2-diaminobenzene dihydrochlorate were used instead of 5 g aniline. The selective filter element of the poly-1,2-diaminobenzene, which contained the substantially equal amounts of amino- and imino-groups, removed about 46% of the acetaldehyde from tobacco smoke in the test as substantially described in Sample 1.

EXAMPLE 4

The present example demonstrates a preparation of a plurality of moieties for a selective filtering element including a carrier of an inorganic oxide. A poly-1,2-diaminobenzene on an about micron-sized silica gel (Syloid, obtained from Davidson Chemical) was prepared as described in Sample 3, except the activated carbon carrier was replaced. The selective filter element of the poly-1,2-diaminobenzene on the about micron-sized silica gel removed about 40% of the aldehydes and exhibited low selectivity.

EXAMPLE 5

The present example demonstrates a preparation of a plurality of moieties for a selective filtering element including a carrier of an zeolite. A polyaniline embedded into an about 9 angstrom (Å) zeolite (molecular sieves 13X as beads of about 0.4 to about 0.8 millimeter (mm) diameter, from Lancaster) cavities was prepared as described for Samples 1 and 2, except that the zeolite carrier was used. The selective filter element of the polyaniline removed about 35% of the acetaldehyde.

EXAMPLE 6

The present example demonstrates a preparation of a plurality of moieties for a selective filtering element including a carrier of polymer. A hydrazido-cellulose was synthesized starting with about 5 g of cellulose powder suspended in about 500 ml of an about 0.5M sodium metaperiodite solution. The resulting slurry was stirred at about room temperature for about 20 hrs. Applicants believe that longer oxidation time may be detrimental, since it is believed that at longer times, the polymer degrades to form water soluble white crystals. About 20 ml of ethylene glycol were added to the slurry followed by about an additional hour of stirring. The oxidized cellulose powder was washed on a cellulosic filter suing about 1 l of water. During filtering, it is recommended that the slurry contain some water to avoid the formation of non-dispersible agglomerates.

The washed material made into a slurry with water at an about 1:1 weight ratio. About 10 g of succinic dihydrazide (SDH) in about 100 ml of water were added (not completely dissolved) to the slurry. The pH of the slurry was adjusted to about 5 using a concentrated HCl solution. After about an 1 hr of stirring, the pH of the slurry was adjusted to about 9 using sodium carbonate. About 10 ml of an about 5M solution of sodium cyanoborohydrate in aqueous about 1M sodium hydroxide were added to the slurry. Then, the slurry was stirred overnight, while in a vented container.

The resultant product was filtered, washed with about 100 ml of an about 0.1M acetic acid, followed by about five washes of about 400 ml each of water, dried in air under a filter paper for about 20 hrs, and stored in ajar. The obtained solid consisted of small particles of a yellowish material mixed with larger sized white agglomerates, which formed during the washing of oxidized cellulose procedure, as mentioned above. These materials are denoted as Sample 2 and Sample 3, respectively, in Table 2.

The sample was milled, sieved to 40–60 mesh fraction of particles, and packed into the cigarette filter in the amounts of about 100 mg and about 250 mg. Then cigarettes were smoked and smoke of the first or fourth puff was analyzed in a GC instrument as described in Sample 1. Results are shown in Table 2.

EXAMPLE 7

The present example demonstrates a preparation of a plurality of moieties for a selective filtering element including a carrier of a polymer. A hydrazido-carboxymethylcellulose was synthesized substantially according to the method described in *Jakoby* et al. [W. B. Jakoby, M. Wilchek. Methods in Enzymology. XXXIV. Affinity Techniques. Enzyme Purification: Part B. 780 pages. Academic Press, New York, 1974.] with modifications. About 10 g of a sodium salt of carboxymethylcellulose having an about 700,000 average molecular weight was dissolved in about 200 ml of water. About 100 ml of an about 10M aqueous solution of hydrazine, adjusted to pH of about 5 to about 6 with concentrated HCl, was then added. About 1 g of 1-ethyl-3-(3-dimethylaminopropyl)-carbodiimide was added and the solution was maintained slightly acidic for about 1 hr. This process was continued for about another 20 hrs without monitoring the pH.

The resultant solution was then poured and vigorously stirred into about 2 l of ethyl alcohol, and cooled on ice. A precipitated polymer was then filtered and washed with about 200 ml of alcohol, dried in air for about 20 hrs, and stored in a jar. The precipitated polymer, designated as Sample 4 in Table 1, was milled and sieved to collect the about 40 to about 60 mesh fraction of particles. These fractions were then placed into the filter holder of a regular cigarette in the amount from 100 mg and 250 mg. Then the cigarettes were mechanically smoked and the smoke was analyzed using a GC instrument. Resulting concentrations of acetaldehyde, acrolein and acetone were normalized to isoprene as an internal standard.

Discussion of Examples 1 through 7

Table 2 contains a summary of the degree of removal of acetaldehyde, acrolein and other RR'CO compounds, represented mostly by acetone, from cigarette smoke by the selective filter elements designated Samples 1 through 4. The filter elements contained about 300 mg of material except that designate Sample 2 which was decreased by a factor of 3 to estimate the capacity of filter element.

TABLE 2

Cigarette smoke filtration by hydrazide derivatives of cellulose.

| Sample | Removal (%) of Acetaldehyde | Acrolein | Other RR'CO |
|---|---|---|---|
| 1** | 0 | 0 | 0 |
| 2** | 100 | 100 | 100 |
| 2(a)§§ | 35 | 10 | 41 |
| 3(b)££ | 100 | 100 | 60 |
| 4** | 96 | 45 | 0 |

**Amount of material used in filter element was about 300 mg
§§Amount of material used in filter element was about 100 mg
The first puff was analyzed in all cases except in the case (b)££ case where three puffs passed the filter and the fourth puff was analyzed.

As may be surmised from the data of Table 2, the removal of aldehydes is very effective when chemically active hydrazide group —NH—$NH_2$ is present in a filtration element. Cellulose as a carrier for hydrazide groups may be advantageous because (1) cellulose bonds hydrazide-group by a strong sigma-bond and therefore may not be released, and (2) cellulose may accept a large concentration of hydrazide-groups, since each cellulose ring can undergo oxidation with the formation of two in-chain aldehyde groups used then to attach a hydrazide.

The results of the experiments showed that other constituents of tobacco smoke were not significantly changed. Therefore, the synthesized filter elements appear to be selective towards RR'CO compounds. Applicants believe that within these compounds additional filter selectivity may be achieved with regard to aldehydes and ketones. As can be seen in Table 2, Samples 2 and 4 had about the same removal activity toward acetaldehyde, and very much different activity toward ketones.

Applicants believe that the active amino-group in Sample 2 is more accessible by a bigger molecule than the active amino-group in Sample 4. This belief is based on the use of a short molecule of hydrazine to modify the polymer in Sample 4. In contrast, the succinic acid spacer used in Sample 2 moved this amino-group far from the polymeric chain, where gaseous carbonyl would experience less steric problems to interact with —$NH_2$ group. Also, a ketone molecule has a larger diameter than an aldehyde molecule, and therefore requires greater space around —$NH_2$ active site. Hydrazide derivatives with a different length of the spacer, such as hydrazine, carbohydrazide, succinic and adipic acids dihydrazides may then be used to synthesize selective traps for carbonyl compounds. Also, this may provide a method to synthesize selectively trapping aldehydes filter.

Carbohydrazide derivatives of oxidized cellulose were synthesized and tested in a filter element. An improved synthesis method for the plurality of moieties was used. The resultant carbohydrazide derivatives of oxidized cellulose removed substantially all of the GC-measurable aldehydes, such as acetaldehyde, acrolein, and ketones, such as acetone, propanal from a tobacco smoke. Also, a test of the filter elements contain carbohydrazide derivatives of oxidized cellulose and indicated that it remained effective for up to about three months in ambient air.

EXAMPLE 8

The present example demonstrates a preparation of a plurality of moieties for a selective filtering element including a carrier of a polymer. A hydrazido-cellulose was synthesized starting with about 5 g of cellulose powder suspended in about 500 ml of an about 0.5M sodium metaperiodate solution. The slurry was stirred at about room temperature for about 3 hrs. About 30 ml of ethylene glycol were added to the slurry, which was then stirred for about an additional hour. The oxidized cellulose powder was washed on a cellulosic filter with about 1 l of water, washed overnight in about 1 l of static water, and then filtered.

The washed material was adjusted to 1:1 weight ratio slurry with water. About 20 g of carbohydrazide in about 300 ml of water were added drop wise to the vigorously stirred cellulosic colloid solution. A dense white precipitation was noticed and appeared to form fast. About 10 ml of an about 5M solution of sodium cyanoborohydrate in an about 1M sodium hydroxide aqueous solution were added. The pH of the solution was adjusted to about 10 with about 2 g of a solid sodium carbonate. It was noted that the pH equilibrated to a level of about 7 to about 8 within about an 1 hour. The white precipitate became yellowish. The mixture was stirred for about 4 hrs.

The solids were then filtered, washed with about 1 l of water, followed by about 300 ml of an about 0.1 M HCl solution, and finally in about 4 l of water. It was noticed that the yellow color instantly disappeared when the 0.1 M HCl solution was added. The resultant solid was found to be quite hydrophobic. The product denoted as Sample 8 in Table 3, was dried in air under a filter paper for about 20 hrs, and stored in a jar.

EXAMPLE 9

The present example demonstrates a preparation of a plurality of moieties for a selective filtering element including a carrier of a polymer. A hydrazido-cellulose was synthesized substantially as described in Sample 8 except that the slurry of oxidized cellulose was added drop wise slowly to a vigorously stirred carbohydrazide solution. A goal of this approach is to reduce to the extent possible cross-linking believed to have occurred in Sample 8. It was noted that, unlike Sample 8, the material remained white throughout the process white turning yellow. The final product denoted as Sample 9 in Table 3 was found a little hydrophobic.

EXAMPLE 10

The present example demonstrates a preparation of a plurality of moieties for a selective filtering element including a carrier of a polymer. A hydrazido-carboxymethylcellulose was synthesized according to the modified method described in Sample 7. About 10 g of a sodium salt of carboxymethylcellulose having an about 700,000 average molecular weight was dissolved in about 300 ml of water at about room temperature and mixed with about 1 l of an about 0.5M $NaIO_4$ aqueous solution. It was believed that viscosity of the polymer solution may have decreased due to depolymerization and, therefore, the it is believed that the duration of oxidation should not exceed about 3 to about 5 hrs.

About 30 g of calcium nitrate in about 100 ml water was added. A white precipitate, which appeared to be insoluble in water, was collected. About 200 ml of a slurry of this material in water was slowly added to a vigorously stirred about 500 ml water solution of about 20 g carbohydrazide. After about 30 min of stirring at about room temperature, the material started turning yellow. Mixing was continued overnight. Then, the solid was filtered, washed in a large amount of water, dried in air, and stored in jar.

The sample denoted Sample 10 in Table 3, was milled and sieved to collect the approximately 40–60 mesh fraction of the particles. Several sample cigarettes were constructed by placing about 250 mg of this sample into the filter holder of an ordinary production Newport cigarette. That is, the filter that came with a Newport cigarette was removed and cut using a razor into two cylindrical sections (a small sections for replacement into the filter holder and a larger section for removal and substitution with the sample material). The sample material was placed into the filter holder nest to the tobacco column. Then the small section was replaced into the filter holder away from the tobacco column to hold the sample material in the of the filter holder. Cigarettes were mechanically smoked and the smoke of the fourth puff was analyzed in a gas chromatograph instrument. The measured concentrations of acetaldehyde, acrolein, acetone and propanal were normalized to ethane as an internal standard. Unaltered Sample 1, or a cellulose-containing research cigarette, served as a reference.

Discussion of Examples 8 through 10

Table 3 contains a summary of the degree of removal of acetaldehyde, acrolein and other RR'CO compounds, represented mostly by acetone and propanal, from cigarette smoke by the Samples 8 through 10 filters elements. Materials from the Samples 8 through 10 were loaded in a filter element in the amount of about 150 mg.

A review of the results indicates that carbohydrazide derivatives are capable of a fast removal of carbonyl compounds from a tobacco smoke. Further, it was noted that the removal was selective and did not affect other compounds, such as hydrocarbons of alcohols.

A sample using the material of Sample 9 showed that the Sample 9 material was most active trap for carbonyls. In Sample 9 care was taken to prevent the reaction of both hydrazide-groups to react with a polymer carrier by providing a large excess of carbohydrazide throughout the reaction with the polymer.

TABLE 3

Cigarette smoke filtration by hydrazide derivatives of cellulose.

| Sample | Removal (%) of Acetaldehyde | Acrolein | Other RR'CO |
|---|---|---|---|
| 8 | 20 | 0 | 0 |
| 9 | 100 | 100 | 100 |
| 10 | 0 | 0 | 0 |

Unaltered Sample 1 Was a Reference

Sample 8 did not show much activity toward carbonyl linkages. It is believed that the cross-linking within a single polymeric chain and/or between polymeric chains by means of both hydrazide groups of carbohydrazide molecule may be a reasonable explanation. The material of Sample 8, therefore, would not contain enough —NH—$NH_2$ groups for reaction with gaseous carbonyls.

The result for the material of Sample 10 corresponds substantially to the result obtained for the material of Sample 7. Both Sample 10 and Sample 7 were prepared using a succinic derivative of hydrazine. In both cases, the oxidation of carboxymethylcellulose with sodium metaperiodate did not appear to form an aldehyde group-enriched polymer. Hence, it is believed that the conditions for hydrazide group incorporation were not created. Polymer scission may have occurred instead.

EXAMPLE 11

The present example demonstrates a preparation of a plurality of moieties for a selective filtering element including a carrier of a polymer and further the extent of the shelf life. A hydrazido-cellulosic material made in Sample 9 was aged in ambient air for about one, three, and six month tests of the filter elements activity and gave substantially the same results as that reported in Table 3, namely about 100% removal of carbonyl compounds.

Certain modifications and improvements will occur to those skilled in the art upon a reading of the foregoing description. By way of example, a cigarette to prevent a delivery of RR'CO compounds found in the mainstream smoke may be achieved by altering combustion temperature. Also, a cigarette to prevent a delivery of RR'CO compounds found in the mainstream smoke may be achieved by altering reacting gas composition. Further, a cigarette to prevent a delivery of RR'CO compounds found in the mainstream smoke may be achieved by altering combustion temperature and reacting gas composition.

A challenge of these changes in mainstream smoke combustion products could be the new spectrum of the formed chemical compounds including carbonyl-containing compounds. The present invention may meet such challenges since the selective filter selectively captures and efficiently filters change while permitting desirous and organoleptic combustion products pass.

It should be understood that all such modifications and improvements have been deleted herein for the sake of conciseness and readability but are properly within the scope of the following claims.

We claim:

1. A smoking article comprising:

a wrapper surrounding a tobacco column; and a selective filter element juxtaposed to said wrapper surrounded tobacco column, said selective filter element having:

at least one carrier; and a polyaniline having a plurality of moieties selected from the group consisting of an amino group, an imino group, a hydrazide group, a hydrazone-group, a semicarbazide group and combinations thereof capable of a nucleophilic attack of carbonyl-containing combustion products of the smoking article supported by the at least one carrier, wherein: the at least one carrier encourages the interaction of the main stream smoke and the plurality of moieties capable of the nucleophilic attack.

2. The smoking article of claim 1 further including an additional filter element.

3. The smoking article of claim 2 wherein the additional filter element is a cellulose acetate filter element.

4. The smoking article according to claim 1, comprising a spacer for attaching the moieties comprises a —CO— group.

5. A selective filter element for use with a smoking article including a wrapper surrounding a tobacco column, the selective filter element juxtaposable to said wrapper surrounded tobacco column comprising:

at least one carrier;

a plurality of moieties selected from the group consisting of an amino group, an imino group, a hydrazide group, a hydrazone-group, a semicarbazide group and combinations thereof capable of a nucleophilic attack of carbonyl-containing combustion products of the smoking article supported by the at least one carrier; and a spacer for attaching the plurality of moieties to the carrier comprising —$[CH_2]_n$—CO—, with n having a value equal to or grater than zero, wherein; the at least one carrier encourages the interaction of a main stream smoke and the plurality of moieties capable of the nucleophilic attack.

6. The selective filter element of claim 5 wherein the carrier comprises a polymer.

7. The selective filter element of claim 6 wherein the polymer comprises a large surface area polymer.

8. The selective filter element of claim 7 wherein the large surface area polymer comprises a branched polymer.

9. The selective filter element of claim 6 wherein the polymer comprises a partially oxidized cellulose.

10. The selective filter element of claim 6 wherein the spacer for attaching the moieties comprises —$[CH_2]_n$—CO— with n having a value greater than 4.

11. The selective filter element of claim 5 wherein the carrier comprises an inorganic oxide.

12. The selective filter element of claim 11 wherein the inorganic oxide comprises a zeolite.

13. The selective filter element of claim 11 wherein the inorganic oxide comprises an oxide of aluminum, silicon, aluminum and silicon, and combinations thereof.

14. The selective filter element of claim 5 wherein the carrier comprises an activated carbon.

15. The selective filter element of claim 5 wherein the spacer for attaching the moieties comprises —$[CH_2]_n$—CO— with n having a value from 1 to 4.

16. The selective filter element of claim 5 wherein the spacer for attaching the moieties comprises —CO—$[CH_2]_n$—CO— with n having a value from 1 to 4.

17. The selective filter element according to claim 5 wherein the spacer for attaching the moieties comprises a —CO—$[CH_2]_n$—CO— with n having a value greater than 4.

18. The selective filter element of claim 5 wherein the plurality of moieties includes an amino group.

19. The selective filter element of claim 18 wherein the amino group is a primary amino group.

20. The selective filter element of claim 5 wherein the plurality of moieties includes a hydrazide derivative.

21. The selective filter element of claim 5 wherein the plurality of moieties includes a hydrazone.

22. The selective filter element according to claim 5 wherein the plurality of moieties includes a semicarbazide.

23. The selective filter element of claim 5 wherein the plurality of moieties includes an imino group.

24. The selective filter element according to claim 20 wherein the hydrazide derivative is a dihydrazide derivative.

25. The selective filter element according to claim 5 wherein the selective filter element is a tip added to the smoking article prior to the smoking of the smoking article.

26. The selective filter element according to claim 25 wherein the tip is added by a smoker.

27. The selective filter element according to claim 26 wherein the smoking article further includes a filter element.

28. A smoking article comprising:

a wrapper surrounding a tobacco column;

a selective filter element juxtaposed to said wrapper surrounded tobacco column, said selective filter element having:

at least one carrier;

a plurality of moieties selected from the group consisting of an amino group, an imino group, a hydrazide group, a hydrazone-group, a semicarbazide group and combinations thereof capable of a nucleophilic attack of carbonyl-containing combustion products of the smoking article supported by the at least one carrier; and a spacer for attaching the plurality of moieties to the carrier, the spacer comprising —$[CH_2]_n$—CO—, with n having a value equal to or greater than zero, wherein: the developed structure of the at least one carrier encourages the interaction of a main stream smoke and the plurality of moieties capable of the nucleophilic attack; and at least one additional filter element.

29. The smoking article of claim 28 wherein the additional filter element is a cellulose acetate filter element.

30. The smoking article of claim 28 wherein the carrier comprises a polymer.

31. The smoking article of claim 30 wherein the polymer comprises a large surface area polymer.

32. The smoking article of claim 31 wherein the large surface area polymer comprises a branched polymer.

33. The smoking article of claim 30 wherein the polymer comprises a partially oxidized cellulose.

34. The smoking article of claim 28 wherein the spacer for attaching the plurality of moieties comprises —$[CH_2]_n$—CO— with n having a value greater than 4.

35. The smoking article of claim 28 wherein the carrier comprises an inorganic oxide.

36. The smoking article of claim 35 wherein the inorganic oxide comprises a zeolite.

37. The smoking article of claim 35 wherein the inorganic oxide comprises an oxide of aluminum, silicon, aluminum and silicon, and combinations thereof.

38. The smoking article of claim 28 wherein the carrier comprises an activated carbon.

39. The smoking article of claim 28 wherein the spacer for attaching the plurality of moieties comprises —$[CH_2]_n$—CO— with n having a value from 1 to 4.

40. The smoking article of claim 28 wherein the spacer for attaching the plurality of moieties comprises —CO—$[CH_2]_n$—CO— with n having a value from 1 to 4.

41. The smoking article of claim 28 wherein the spacer for attaching the plurality of moieties comprises —CO—$[CH_2]_n$—CO— with n having a value from 1 to 4.

42. The smoking article of claim 28 wherein the plurality of moieties includes an amino group.

43. The smoking article of claim 42 wherein the amino group is a primary amino group.

44. The smoking article of claim 28 wherein the plurality of moieties includes a hydrazide derivative.

45. The smoking article of claim 28 wherein the plurality of moieties includes a hydrazone.

46. The smoking article of claim 28 wherein the plurality of moieties includes a semicarbazide.

47. The smoking article of claim 28 wherein the plurality of moieties includes an imino.

48. The smoking article of claim 44 wherein the hydrazide derivative is a dihydrazide derivative.

49. The smoking article of claim 28 wherein the selective filter element is a tip added to the surrounded tobacco column prior to the smoking of the smoking article.

50. The smoking article of claim 49 wherein the tip is added by a smoker.

51. The smoking article of claim 50 wherein the smoking article further includes a second additional filter element.

52. The smoking article of claim 51 wherein the second additional filter element is a cellulose acetate filter element.

53. The selective filter element according to claim 24 wherein the dihydrazide derivative initially comprises one of adipic acid dihydrazide, succinic dihydrazide and combinations thereof.

54. The smoking article of claim 48 wherein the dihydrazide derivative initially comprises one of adipic acid dihydrazide, succinic dihydrazide and combinations thereof.

55. A selective filter element for use with a smoking article including a wrapper surrounding a tobacco column, the selective filter element juxtaposable to said wrapper surrounded tobacco column and having:

at least one carrier comprising a partially oxidized cellulose;

a plurality of moieties initially comprising a dihydrazide derivative capable of a nucleophilic attack of carbonyl-containing combustion products of the smoking article supported by the at least one carrier; and a spacer for attaching the plurality of moieties to the carrier comprising —$[CH_2]_n$—CO—, with n having a values equal to or greater than zero, wherein; the at least one carrier encourages the interaction of a main stream smoke and the plurality of moieties capable of the nucleophilic attack.

56. A method for making a smoking article comprising:

surrounding tobacco with a wrapper to create a tobacco column and juxtaposing a selective filter element and the tobacco column so as to encourage a passing of at least a portion of combustion products of the wrapper and tobacco through the selective filter element when the tobacco column is burned, wherein the selective filter element includes a polyaniline having a plurality of moieties selected from the group consisting of an amino group, an imino group, a hydrazide group, a hydrazone-group, a semicarbazide group and combinations thereof capable of the nucleophilic attack of carbonyl-containing compounds in the combustion products so as to substantially selectively filter at least a portion of the carbonyl-containing compounds from the combustion products.

57. A method for making a smoking article comprising:

surrounding tobacco with a wrapper to create a tobacco column;

creating a filter element by supporting a plurality of moieties with a spacer for attaching the plurality of moieties to a carrier, wherein the spacer comprises —$[CH_2]_n$—CO—, with n having a value equal to or greater than zero, the moieties selected from the group consisting of an amino group, an imino group, a hydrazide group, a hydrazone-group, a semicarbazide group and combinations thereof being capable of the nucleophilic attack of carbonyl-containing combustion products of the wrapper and tobacco when the tobacco column is burned; and juxtaposing the filter element and the tobacco column so as to encourage a passing of at least a portion of the combustion products of the wrapper and tobacco through the filter element when the tobacco column is burned to substantially selectively filter at least a portion of the carbonyl-containing compounds from the combustion products.

58. A method for making a smoking article comprising:

surrounding tobacco with a wrapper to create a tobacco column;

creating a filter element by developing a structure of at least one carrier and supporting a plurality of moieties with a spacer comprising —$[CH_2]_n$—CO—, n having a value equal to or greater than zero on the at least one carrier, the moieties selected from the group consisting of an amino group, an imino group, a hydrazide group, a hydrazone-group, a semicarbazide group and combinations thereof being capable of the nucleophilic attack of carbonyl-containing combustion products of the wrapper and tobacco when the tobacco column is burned;

juxtaposing the filter element and the tobacco column so as to encourage a passing of at least a portion of the combustion products of the wrapper and tobacco through the filter element when the tobacco column is burned to substantially selectively filter at least a portion of the carbonyl-containing compounds from the combustion products; and juxtaposing at least one additional filter element, the filter element and the said tobacco column so as to encourage a passing of the combustion products past at least one additional filter element.

59. A filter element for selectively filtering carbonyl-containing combustion products of a smoking article that includes a wrapper surrounding a tobacco column after use with the smoking article comprising the filter element having a reaction product of a carbonyl-containing combustion products of the wrapper and tobacco and a polyaniline having at least one of a plurality of moieties selected from the group consisting of an amino group, an imino group, a hydrazide group, a hydrazone-group, a semicarbazide group and combinations thereof capable of the nucleophilic attack of the carbonyl-containing combustion products.

60. A filter element for selectively filtering carbonyl-containing combustion products of a smoking article that includes a wrapper surrounding a tobacco column after use with the smoking article comprising the filter element having a reaction product of a carbonyl-containing combustion product of the wrapper and tobacco and at least one of a plurality of moieties selected from the group consisting of an amino group, an imino group, a hydrazide group, a hydrazone-group, a semicarbazide group and combinations thereof capable of the nucleophilic attack of the carbonyl-containing combustion products, the plurality of moieties supported by a spacer to at least one carrier, wherein the spacer comprises —$[CH_2]_n$—CO—, with n having a value equal to or greater than zero.

61. A filter for selectively filtering carbonyl-containing combustion products of a smoking article that includes a wrapper surrounding a tobacco column after use with the smoking article comprising a first filter element having a reaction product of a carbonyl-containing combustion product of the wrapper and tobacco and at least one of a plurality of moieties selected from the group consisting of an amino group, an imino group, a hydrazide group, a hydrazone-group, a semicarbazide group and combinations thereof capable of the nucleophilic attack of the carbonyl-containing combustion products, the plurality of moieties supported a value of one of from 0 to 4 and greater than 4 and at least a second additional filter element.

* * * * *